US010921015B2

(12) United States Patent
Rajendran et al.

(10) Patent No.: US 10,921,015 B2
(45) Date of Patent: Feb. 16, 2021

(54) SYSTEMS AND METHODS FOR ADJUSTMENT OF HEAT EXCHANGER POSITION

(71) Applicant: Johnson Controls Technology Company, Auburn Hills, MI (US)

(72) Inventors: Vinoraj Rajendran, Cuddalore (IN); Mujibul R. Mohammad, Kakinada (IN); Anil V. Bhosale, Taluka Karad (IN); Ganesh S. Devkhile, Pune (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 182 days.

(21) Appl. No.: 16/116,753

(22) Filed: Aug. 29, 2018

(65) Prior Publication Data

US 2020/0072488 A1 Mar. 5, 2020

Related U.S. Application Data

(60) Provisional application No. 62/723,680, filed on Aug. 28, 2018.

(51) Int. Cl.

| | |
|---|---|
| ***F24F 11/89*** | (2018.01) |
| ***F24F 13/30*** | (2006.01) |
| ***F24D 19/10*** | (2006.01) |

(52) U.S. Cl.

CPC ..... *F24F 11/89* (2018.01); *F24D 19/1084* (2013.01); *F24F 13/30* (2013.01); *F24D 2220/06* (2013.01); *F24F 2221/16* (2013.01)

(58) Field of Classification Search

CPC ..... F24F 11/89; F24F 13/30; F24D 19/1084; F24D 2220/06; F24D 2221/16

See application file for complete search history.

(56) References Cited

U.S. PATENT DOCUMENTS

| | | | | | |
|---|---|---|---|---|---|
| 2,105,692 | A * | 1/1938 | Hunicke | F24F 3/14 | 165/86 |
| 2,147,283 | A * | 2/1939 | Covell | F28D 1/024 | 165/86 |
| 3,625,022 | A * | 12/1971 | Johnson | F24F 3/044 | 62/159 |
| 3,743,010 | A * | 7/1973 | Farney | F24F 3/00 | 165/207 |
| 3,979,922 | A * | 9/1976 | Shavit | F24F 3/0525 | 62/97 |
| 4,018,266 | A * | 4/1977 | Kay | F24F 1/02 | 165/237 |

(Continued)

FOREIGN PATENT DOCUMENTS

| | | | | |
|---|---|---|---|---|
| JP | 11201544 A * | 7/1999 | F28F 1/32 | |
| JP | 2001047845 A * | 2/2001 | | |

(Continued)

*Primary Examiner* — Nelson J Nieves

(74) *Attorney, Agent, or Firm* — Fletcher Yoder, P.C.

(57) ABSTRACT

The present disclosure relates to a heating, ventilation, and/or air conditioning (HVAC) system including a heating coil and an actuation system configured to couple to the heating coil. The actuation system is configured to rotatably position the heating coil in a first orientation crosswise to an airflow path in a heating mode, and rotatably position the heating coil in a second orientation substantially removed from the airflow path in a cooling mode.

30 Claims, 10 Drawing Sheets

(56) References Cited

U.S. PATENT DOCUMENTS 4,105,063 A * 8/1978 Bergt ..... F24F 3/14 165/228
4,513,809 A * 4/1985 Schneider ..... F24F 12/001 165/54
4,750,544 A * 6/1988 Halsne ..... F24F 11/72 165/286
5,001,905 A * 3/1991 Miyazaki ..... B60H 1/00371 454/161
5,050,667 A * 9/1991 Berner ..... F24F 7/065 165/137
5,839,288 A * 11/1998 Dotson ..... F24F 3/044 62/94
6,598,400 B2 * 7/2003 Nash ..... F02C 6/18 165/DIG. 138
7,165,416 B2 * 1/2007 Lee ..... F24F 1/022 62/285
7,322,205 B2 1/2008 Bourne et al.
7,582,009 B1 9/2009 Cote
8,038,075 B1 10/2011 Walsh
8,616,265 B2 * 12/2013 Fell ..... F01P 3/18 165/41
9,074,780 B2 * 7/2015 Lee ..... F24F 1/0059
9,273,373 B2 3/2016 Nakatsu et al.
9,624,911 B1 4/2017 Griffith et al.
9,671,125 B2 6/2017 Mowris et al.
9,671,131 B2 6/2017 Cohen
9,803,876 B2 10/2017 MacDuff et al.
2006/0005959 A1 * 1/2006 Maeda ..... F28D 1/05366 165/202
2006/0162367 A1 * 7/2006 Yabu ..... B01D 53/261 62/271
2007/0205297 A1 * 9/2007 Finkam ..... F24F 11/30 236/1 C
2008/0203866 A1 * 8/2008 Chamberlain ..... F24F 1/0007 312/236
2010/0084115 A1 * 4/2010 Sung ..... B60H 1/00321 165/63
2011/0041534 A1 * 2/2011 Hombucher ..... F24F 5/0046 62/238.1
2014/0260965 A1 * 9/2014 Finkam ..... B60H 1/039 95/12
2015/0194558 A1 * 7/2015 Wang ..... H02S 40/44 320/101
2015/0369524 A1 * 12/2015 Ikegami ..... F24F 3/1411 165/61
2017/0045255 A1 2/2017 Karamanos et al.
2017/0198982 A1 * 7/2017 Tornquist ..... F24D 17/0052
2018/0100671 A1 * 4/2018 Snider ..... F24F 13/10
2019/0011137 A1 * 1/2019 Horie ..... F24F 11/77
2019/0011153 A1 * 1/2019 Liu ..... F25B 39/00

FOREIGN PATENT DOCUMENTS

JP 2007106340 A * 4/2007 ..... B60H 1/3211
JP 2007113831 A * 5/2007
WO 2010026437 A2 3/2010
WO 2017091855 A1 6/2017
WO 2018053635 A1 3/2018

* cited by examiner

SYSTEMS AND METHODS FOR ADJUSTMENT OF HEAT EXCHANGER POSITION

CROSS-REFERENCE TO RELATED APPLICATIONS

This application claims priority from and the benefit of U.S. Provisional Application Ser. No. 62/723,680, entitled "SYSTEMS AND METHODS FOR ADJUSTMENT OF HEAT EXCHANGER POSITION", filed Aug. 28, 2018, which is herein incorporated by reference in its entirety for all purposes.

BACKGROUND

This disclosure relates generally to heating, ventilation, and air conditioning (HVAC) systems. Specifically, the present disclosure relates to a system and method for adjusting the position of a heat exchanger in HVAC units.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light and not as an admission of any kind.

A heating, ventilation, and air conditioning (HVAC) system may be used to thermally regulate an environment, such as a building, home, or other structure. The HVAC system generally includes a vapor compression system, which includes heat exchangers, such as a condenser and an evaporator, which transfer thermal energy between the HVAC system and the environment. In some cases, the HVAC system also includes a hydronic heating coil, which, together with the evaporator, is disposed within a flow path of the HVAC system. A fan is typically disposed within the flow path and is configured to direct a flow of air across the hydronic heating coil and the evaporator. The hydronic heating coil may be non-operational when the HVAC system is operating in a cooling mode, and the HVAC system may condition the flow of air via the evaporator. However, because the evaporator and the hydronic heating coil are both disposed within the flow path, conventional HVAC systems typically direct the flow of air across a heat exchange area of the evaporator and a heat exchange area of the hydronic heating coil, even when the hydronic heating coil is inactive. Unfortunately, the hydronic heating coil may hinder airflow along the flow path and increase a pressure drop of the airflow, which may increase a power consumption of the fan, and thus, reduce an operational efficiency of the HVAC system.

SUMMARY

The present disclosure relates to a heating, ventilation, and/or air conditioning (HVAC) system including a heating coil and an actuation system configured to couple to the heating coil. The actuation system is configured to rotatably position the heating coil in a first orientation crosswise to an airflow path in a heating mode, and rotatably position the heating coil in a second orientation substantially removed from the airflow path in a cooling mode.

The present disclosure also relates to a heating, ventilation, and/or air conditioning (HVAC) system including a heating coil and an actuation system coupled to the heating coil, where the actuation system is configured to rotate the heating coil. The HVAC system also includes a controller configured to regulate operation of the actuation system to rotate the heating coil between a first orientation and a second orientation based on an operating parameter of the HVAC system. The heating coil is disposed within an airflow path of the HVAC system in the first orientation, and is substantially removed from the airflow path in the second orientation.

The present disclosure also relates to a rooftop unit for a heating, ventilation, and/or air conditioning system including an enclosure defining an airflow path through the rooftop unit, an evaporator disposed within the enclosure and within the airflow path, and a heating coil rotatably coupled to the enclosure and configured to transition between a first orientation and a second orientation. The heating coil is disposed within the airflow path in the first orientation and the heating coil is substantially removed from the airflow path in the second orientation. The rooftop unit also includes an actuator disposed within the housing and configured to transition the heating coil between the first orientation and the second orientation.

BRIEF DESCRIPTION OF THE DRAWINGS

Various aspects of this disclosure may be better understood upon reading the following detailed description and upon reference to the drawings in which.

DETAILED DESCRIPTION

Figure 1:
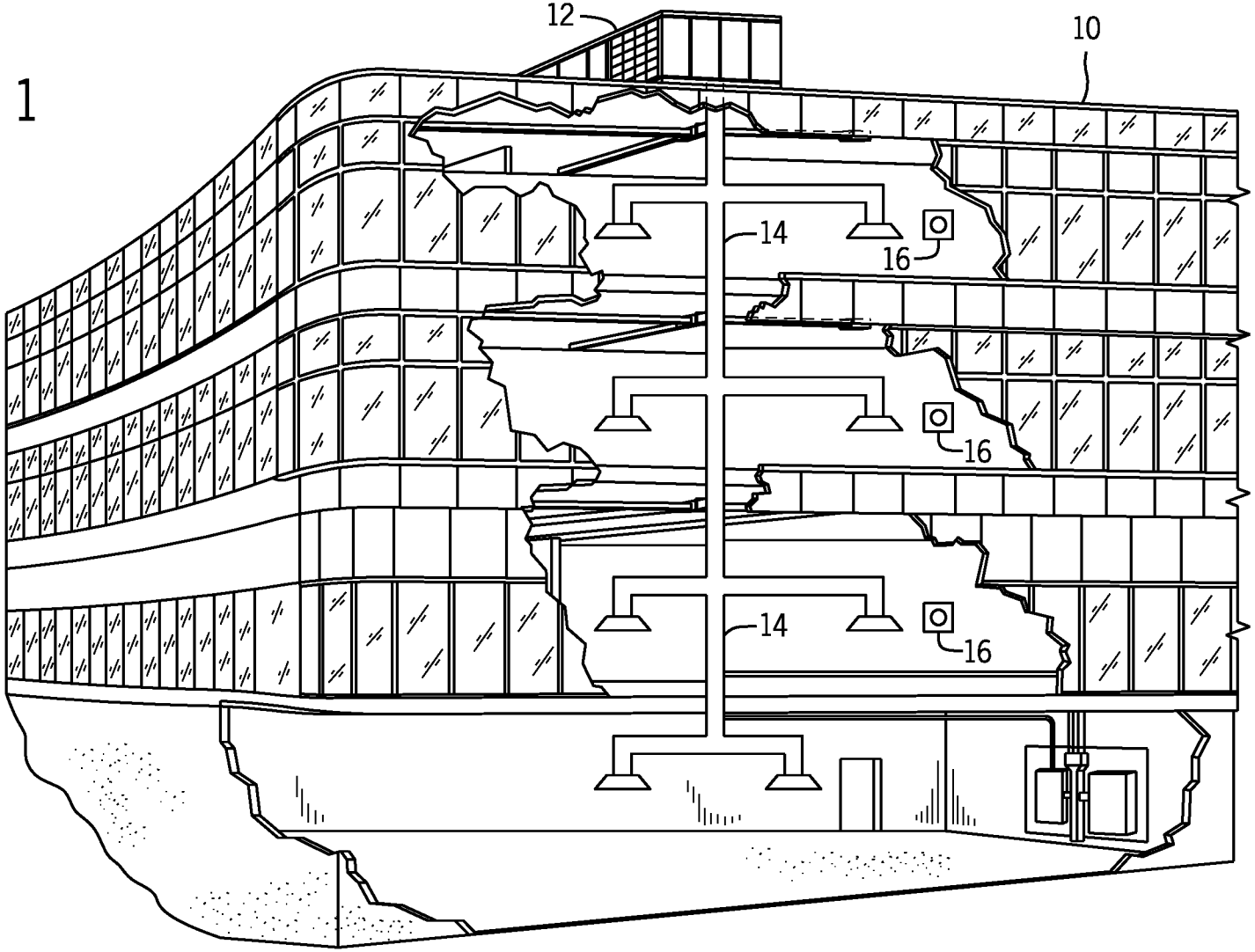
FIG. 1 is a perspective view of an embodiment of a building that may utilize a heating, ventilation, and air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

A heating, ventilation, and air conditioning (HVAC) system may be used to thermally regulate a space within a building, home, or other suitable structure. For example, the HVAC system may include a vapor compression system that transfers thermal energy between a heat transfer fluid, such as a refrigerant, and a fluid to be conditioned, such as air. The vapor compression system includes a condenser and an evaporator that are fluidly coupled to one another via a conduit. A compressor may be used to circulate the refrigerant through the conduit and, thus, enable the transfer of thermal energy via the refrigerant in the condenser and the evaporator.

In many cases, the evaporator of the HVAC system may be used to condition a flow of air entering a building from an ambient environment, such as the atmosphere. For example, in cases when the HVAC system is operating in a cooling mode, a supply duct may direct a flow of supply air across a heat exchange area of the evaporator to enable absorption of thermal energy from the supply air by refrigerant circulating through the evaporator. Accordingly, the evaporator cools the supply air, and the supply air is discharged from the evaporator as conditioned air that is directed into the building. In some cases, the refrigerant within the evaporator may absorb sufficient thermal energy to boil, such that the refrigerant exits the evaporator in a hot, gaseous phase. The compressor circulates the gaseous refrigerant toward the condenser, which may be used to remove the absorbed thermal energy from the refrigerant. For example, ambient air from the atmosphere may be drawn through a heat exchange area of the condenser to enable thermal energy transfer from the gaseous refrigerant to the ambient air. In many cases, the condenser may enable the refrigerant to change phase, or condense, from the gaseous phase to the liquid phase. Thereafter, the liquid refrigerant may be redirected toward the evaporator for reuse.

In certain cases, the HVAC system includes additional heat exchangers. For example, the HVAC system may include a hydronic coil, such as a hydronic heating coil, which may be disposed adjacent the evaporator. The hydronic heating coil may be configured to heat, rather than cool, a flow of air circulating through the HVAC system. For example, when the HVAC system is operating in a heating mode, a heated fluid source, such as a boiler, may direct a heated working fluid through the hydronic heating coil. The supply duct directs the supply air across a heat exchange area of the hydronic heating coil, to enable transfer of thermal energy from the heated working fluid to the supply air. Thus, the hydronic heating coil may discharge heated air. Accordingly, the heated air may be directed toward the building via suitable ductwork.

In conventional HVAC systems, both the evaporator and the hydronic heating coil are disposed within a common flow path of the HVAC system. The HVAC system activates the evaporator and deactivates the hydronic heating coil when the HVAC system is operating in the cooling mode. Conversely, the HVAC system deactivates the evaporator and activates the hydronic heating coil when the HVAC system is operating in the heating mode. However, because the evaporator and the hydronic heating coil are both disposed within the flow path, the HVAC system continuously directs the air across a respective heat exchange area of both the evaporator and the hydronic heating coil, even when the HVAC system is operating in the cooling mode during which the hydronic heating coil is inactive. As noted above, the hydronic heating coil may restrict airflow along the flow path and increase a pressure drop of the airflow, which may increase a power consumption of one or more fans directing the air, and thus, reduce an operational efficiency of the HVAC system.

It is now recognized that an energy efficiency of the HVAC system may be improved by removing the hydronic heating coil from the flow path when the HVAC system is operating in a cooling mode. Removing the hydronic heating coil from the flow path may decrease a pressure drop of air flowing along the flow path, which may reduce a power consumption of the one or more fans, and thus, enhance an operational efficiency of the HVAC system.

Embodiments of the present disclosure are directed to an actuation mechanism that may be used to substantially remove the hydronic heating coil from the flow path during certain operation periods of the HVAC system, such as when the HVAC system is operating in a cooling mode. The actuation mechanism includes an actuator that may be coupled to a top panel of a central housing of the HVAC system. The actuator is configured to transition the hydronic heating coil between a first position, in which the hydronic heating coil is disposed within the flow path, and a second position, in which the hydronic heating coil is substantially removed from the flow path. The hydronic heating coil may couple to the top panel of the central housing via a hinge assembly. The hinge assembly enables the hydronic heating coil to rotate about a rotational axis of the hinge assembly between the first position, in which the hydronic heating coil is oriented generally parallel to the evaporator and substantially cross-wise to a flow of the air along the flow path, and the second position, in which the hydronic heating coil is oriented generally perpendicular to the evaporator and is removed, or substantially removed, from the flow path. A coupling, such as a chain or wire, extends between the hydronic heating coil and the actuator. The actuator may retrieve or release the coupling, and thus, transition the hydronic heating coil between the first and second positions. In certain embodiments, the actuation mechanism includes a support bracket that is configured to maintain the hydronic heating coil in the second position during certain operational periods of the HVAC system, such as when the HVAC system operates in the cooling mode or when a service technician performs maintenance operations on the HVAC system.

In some embodiments, the actuation mechanism includes a controller that is communicatively coupled to the actuator. The controller may be configured to instruct the actuator to transition the hydronic heating coil between the first position and the second position based on certain operational parameters or operational modes of the HVAC system. For example, in some embodiments, the controller may receive feedback from one or more sensors disposed within the central housing indicative of an air temperature of the air flowing along the flow path, and may determine whether to remove the hydronic heating coil from the flow path based on the determined air temperature value. In other embodiments, the sensors may be positioned elsewhere, including external to the HVAC system, to measure other parameters, such as a temperature of air in a space conditioned by the HVAC system. These and other features will be described below with reference to the drawings.

Further, while the present disclosure describes the actuation mechanism as configured for use with a hydronic heating coil, it should be appreciated that the disclosed embodiments may be implemented with other heat exchangers or coils. For example, the techniques described herein may be used with condensers, evaporators, other cooling coils, other heating coils, or any suitable heat exchanger in order to transition the heat exchanger between a first position within an airflow path and a second position substantially removed from the airflow path.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
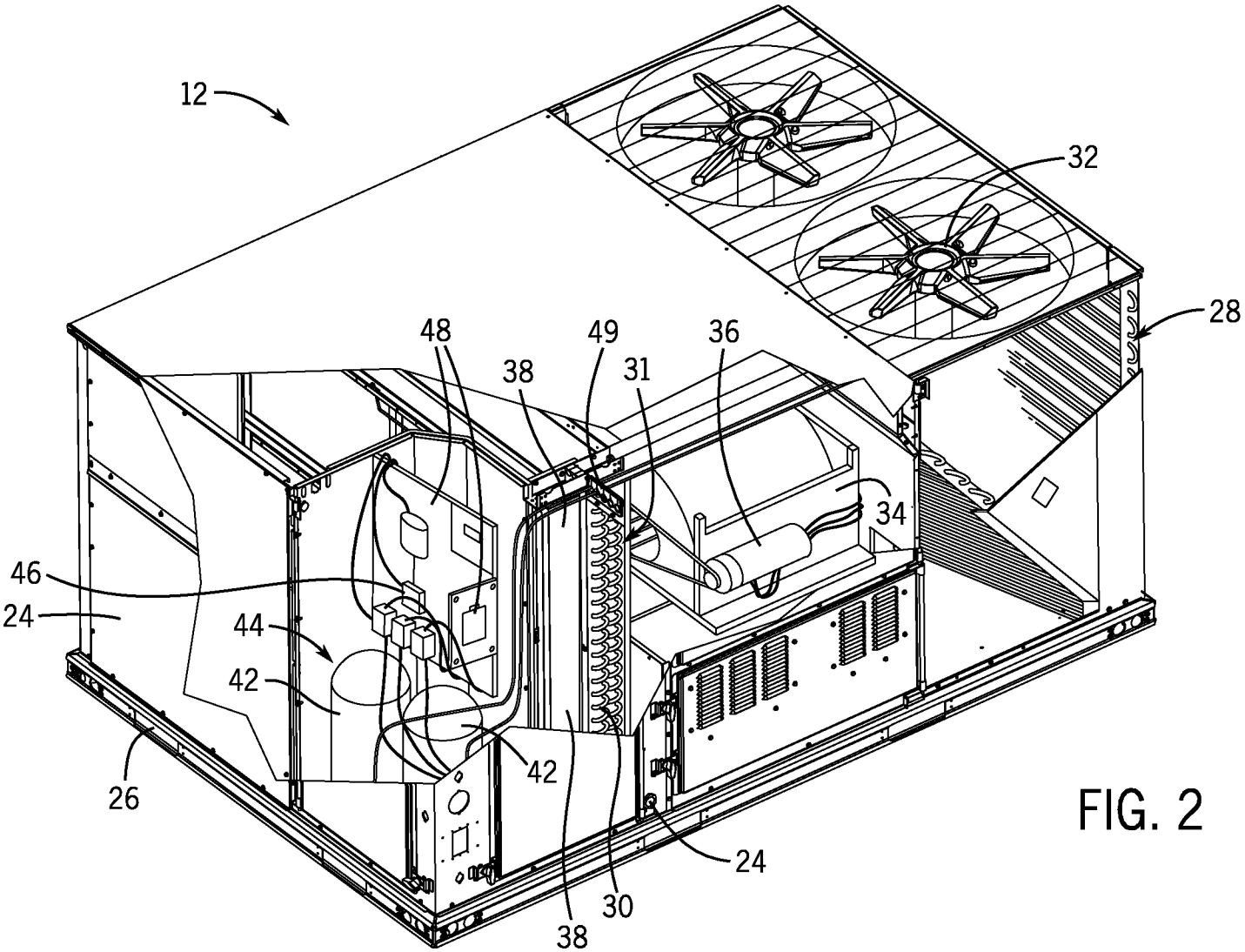
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
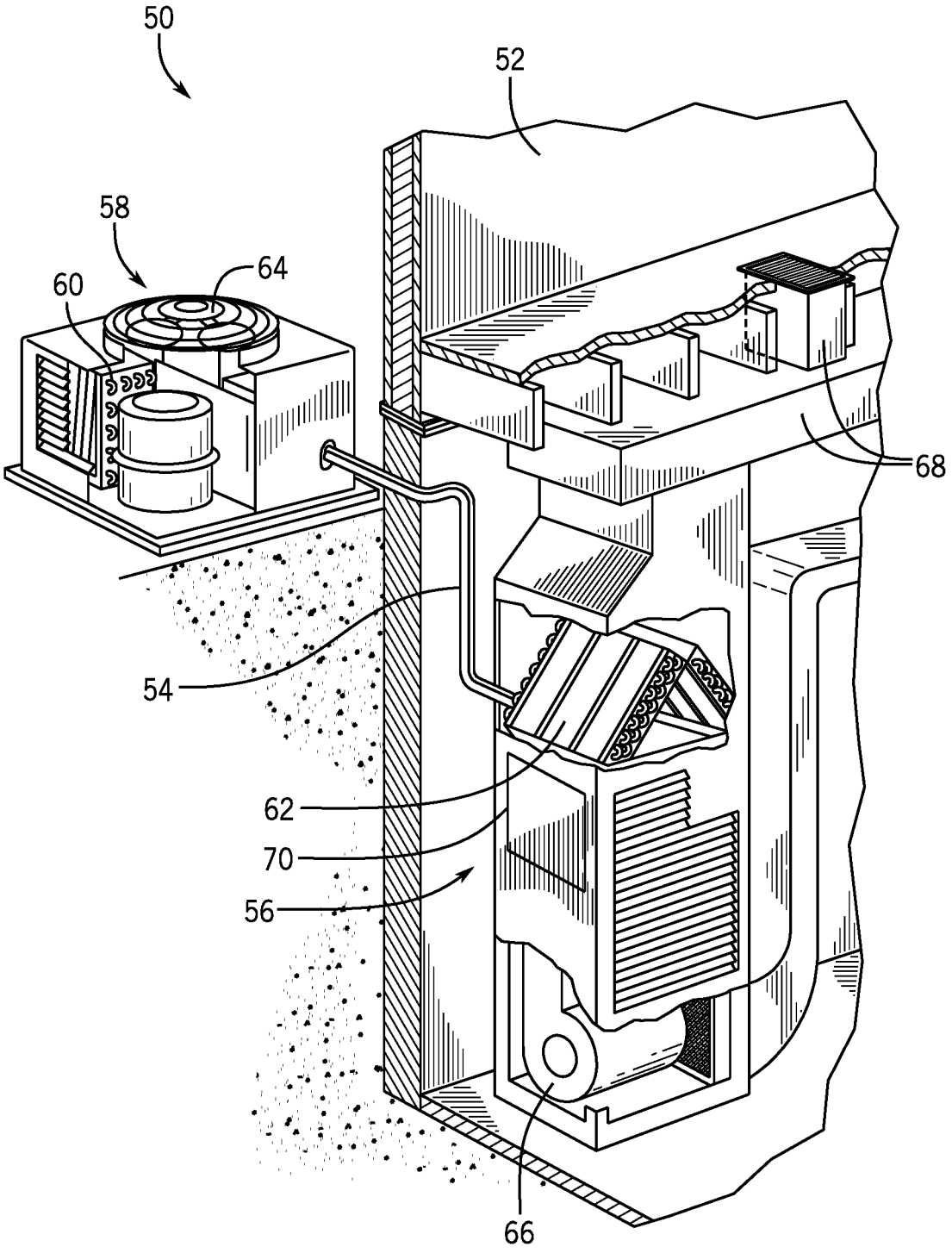
FIG. 3 is a perspective view of an embodiment of a residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
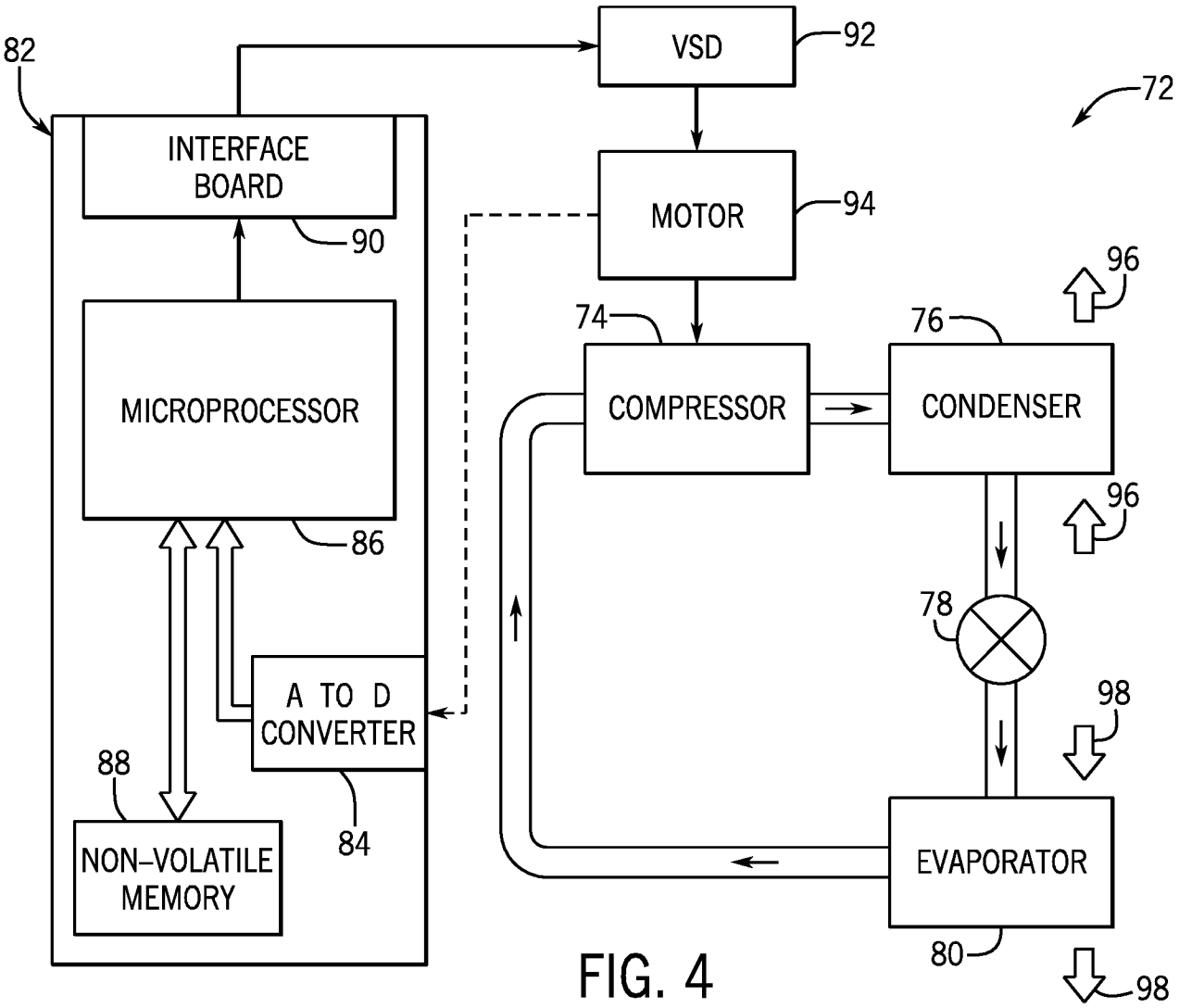
FIG. 4 is a schematic diagram of an embodiment of a vapor compression system that may be used in the packaged HVAC system of FIG. 2 and the residential HVAC system FIG. 3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or any other suitable HVAC systems. In some embodiments, the HVAC unit 12 is a designated heating system configured to operate in a heating mode and heat an air flow traversing through the HVAC unit 12. In other embodiments, the HVAC unit 12 may be a designated cooling system configured to operate in a cooling mode and cool, or condition, an air flow traversing through the HVAC unit 12. In yet further embodiments, the HVAC unit 12 may selectively transition between a heating mode or a cooling mode to heat or cool, respectively, an air flow traversing the HVAC unit 12. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
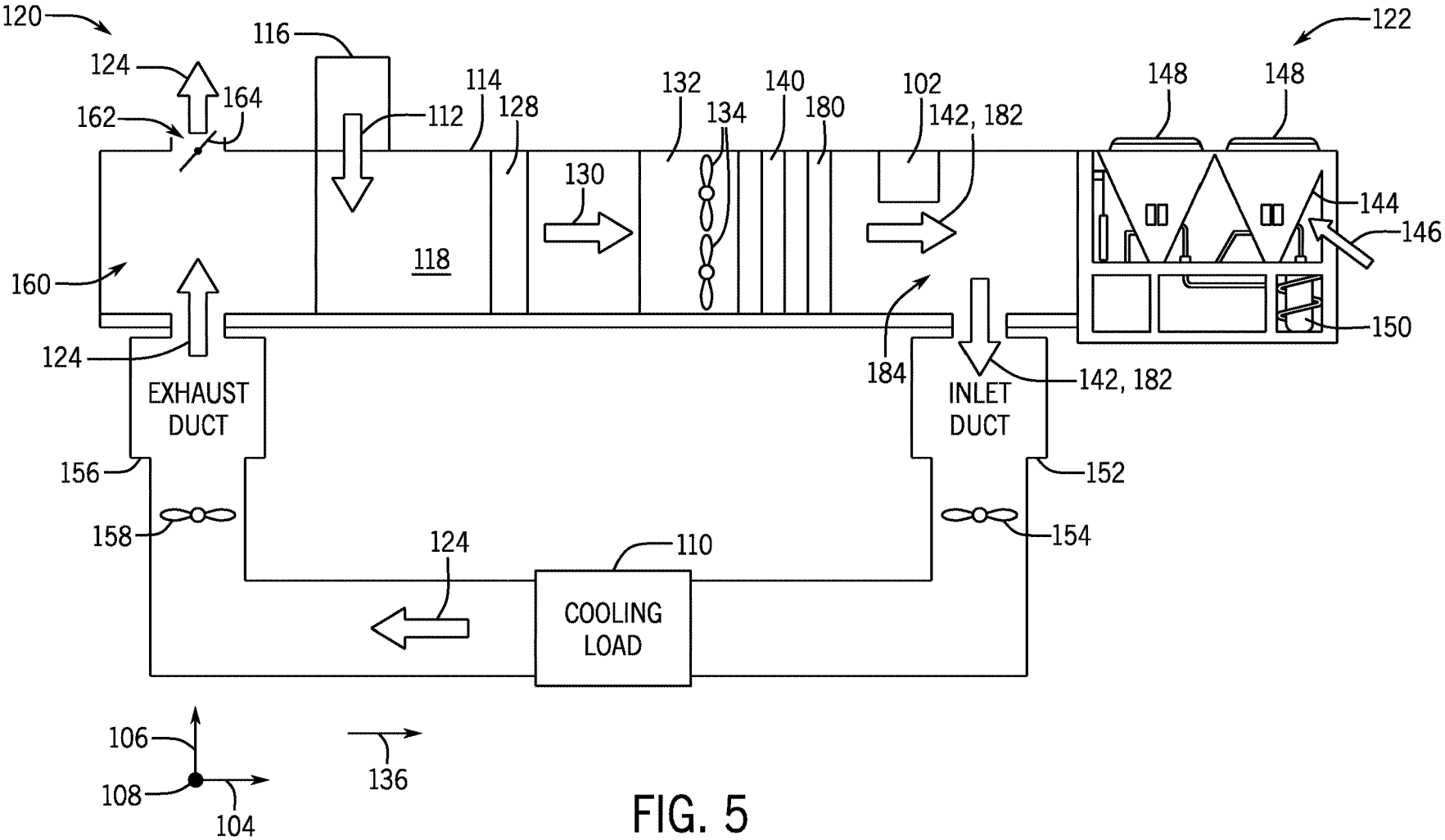
FIG. 5 is a schematic view of an embodiment of an HVAC system including a heat exchanger actuation mechanism, in accordance with an aspect of the present disclosure.

With the foregoing in mind, FIG. 5 illustrates a schematic diagram of an embodiment of a heating, ventilation, and air conditioning (HVAC) system 100 including a hydronic coil actuation system 102. It should be noted that the HVAC system 100 may include embodiments or components of the HVAC unit 12 shown in FIG. 1, embodiments or components of the residential heating and cooling system 50 shown in FIG. 3, a rooftop unit (RTU), or any other suitable HVAC system. To facilitate discussion, the HVAC system 100 and its components may be described with reference to a longitudinal axis or direction 104, a vertical axis or direction 106, and a lateral axis or direction 108. For clarity, it should be noted that the HVAC system 100 is operating in a cooling mode in the illustrated embodiment of FIG. 5. That is, the HVAC system 100 is configured to supply a flow of conditioned air to a cooling load 110 or a thermal load, such as a building, residential home, or any other conditioned space. However, as described in greater detail herein, the HVAC system 100 may also operate in a heating mode, in which the HVAC system 100 is configured to heat, rather than cool, the flow of air supplied to the cooling load 110. Accordingly, the HVAC system 100 may maintain a desired air quality and air temperature within the cooling load 110.

Regardless, fresh outdoor air 112 may be directed into an enclosure or a central housing 114 the HVAC system 100 via an inlet duct 116. The central housing 114 defines a flow path 118 that extends from an upstream end portion 120 to a downstream end portion 122 of the central housing 114. As described in greater detail herein, the outdoor air 112 may mix with a portion of exhaust air 124, or return air, discharging from the cooling load 110, which may be recirculated through the HVAC system 100 along the flow path 118. The HVAC system 100 includes an air blender 128 that blends the outdoor air 112 and the exhaust air 124, such that the mixture of the outdoor air 112 and the exhaust air 124 is discharged from the air blender 128 as supply air 130. A fan section 132 including one or more flow generating devices, such as one or more fans 134, is disposed within the central housing 114 and is configured to direct the supply air 130 along the flow path 118 in a downstream direction 136, which extends generally parallel to the longitudinal axis 104.

The fan section 132 directs the supply air 130 across an evaporator 140 disposed downstream of the fan section 132. When the HVAC system 100 is operating in the cooling mode, the evaporator 140 may absorb thermal energy from the supply air 130, such that the supply air 130 discharges from the evaporator 140 as cooled air 142. For example, the one or more fans 134 may direct the supply air 130 across a heat exchange area of the evaporator 140, and liquid refrigerant within the evaporator 140 may absorb thermal energy, such as heat, from the supply air 130. In other words, the evaporator 140 decreases a temperature of the supply air 130 and, thus, discharges the cooled air 142 at a temperature that is less than a temperature of the supply air 130.

In many cases, the thermal energy absorbed by the liquid refrigerant within the evaporator 140 may heat the liquid refrigerant to a hot, gaseous phase. The gaseous refrigerant is directed to a condenser 144, which may remove the absorbed thermal energy from the refrigerant and transfer the thermal energy to a cooling fluid, such as ambient air 146 from the atmosphere. For example, one or more condenser fans 148 may direct a flow of the ambient air 146 across a heat exchange area of the condenser 144, and the ambient air 146 may absorb thermal energy from the gaseous refrigerant. The ambient air 146 discharges into the atmosphere after passing through the heat exchange area of the condenser 144. Accordingly, the gaseous refrigerant may condense into a liquid phase, and a compressor 150 of the HVAC system 100 may redirect the liquid refrigerant back toward the evaporator 140.

The cooled air 142 is directed into an inlet duct 152 that fluidly couples the cooling load 110 to the HVAC system 100. In some embodiments, an inlet duct fan 154 may facilitate flow of the cooled air 142 toward the cooling load 110. The cooled air 142 may flow through the cooling load 110 and may exit the cooling load 110 as the exhaust air 124. For example, the cooled air 142 may absorb thermal energy from the cooling load 110, and the exhaust air 124 may exit the cooling load 110 at a temperature greater than a temperature of the cooled air 142. The exhaust air 124 may be directed toward the HVAC system 100 through an exhaust duct 156, which fluidly couples the cooling load 110 to the HVAC system 100. Similar to the inlet duct 152, an exhaust duct fan 158 may be disposed within the exhaust duct 156 to facilitate flow of the exhaust air 124 from the cooling load 110 toward the HVAC system 100. The exhaust air 124 may subsequently flow from the exhaust duct 156 into an exhaust section 160 of the central housing 114.

As shown in the illustrated embodiment, the exhaust section 160 includes an aperture 162 that is configured to discharge a portion of the exhaust air 124, or substantially all of the exhaust air 124, from the exhaust section 160 and into an ambient environment. An exhaust air damper 164 is disposed within the aperture 162 and is configured to modulate a flow rate of the exhaust air 124 discharging from the exhaust section 160. For example, when the exhaust air damper 164 is disposed in a fully open position or in a partially open position, a portion of the exhaust air 124 may discharge through the aperture 162 and into the ambient environment. In such embodiments, a remaining portion of the exhaust air 124 within the exhaust section 160 may be recirculated through the HVAC system 100 and the cooling load 110, as noted above. The HVAC system 100 may intake the fresh outdoor air 112 to replace the discharged exhaust air 124. As described in greater detail herein, the HVAC system 100 may thus ensure that a quality of air circulating through the cooling load 110 is maintained at or above a target value. However, in some embodiments, the exhaust air damper 164 may also transition to a fully closed position, whereby substantially all exhaust air 124 discharging from the exhaust duct 156 is recirculated through the HVAC system 100.

As shown in the illustrated embodiment of FIG. 5, the HVAC system 100 also includes a hydronic heating coil 180 that is disposed within the central housing 114 and downstream of the evaporator 140. As noted above, the hydronic heating coil 180 is configured to heat, rather than cool, the supply air 130 when the HVAC system 100 is operating in a heating mode. For example, when the HVAC system 100 operates in the heating mode, a heating working fluid, such as steam, heated water or hot water, oil, or the like, is circulated through the hydronic heating coil 180, while refrigerant flow through the evaporator 140 is suspended. The fan section 132 directs the supply air across 130 a heat exchange area of the hydronic heating coil 180, and the supply air 130 absorbs thermal energy from the heated working fluid circulating through the hydronic heating coil 180. Accordingly, the supply air 130 may discharge from the hydronic heating coil as heated air 182, which is directed toward the cooling load 110 via the inlet duct 152.

In conventional HVAC systems, the hydronic heating coil 180 is typically fixedly coupled within the central housing 114, such that the hydronic heating coil 180 remains disposed within the flow path 118 even when the HVAC system 100 is operating in the cooling mode and the hydronic heating coil 180 is inactive or non-operational. Accordingly, the fan section 132 directs the supply air 130 across the heat exchange area of the evaporator 140 and the heat exchange area of the inactive hydronic heating coil 180 during cooling operation of the HVAC system 100. Unfortunately, the heat exchange area of the hydronic heating coil 180 may restrict the flow path 118, and thus, inhibit flow of the supply air 130 to the cooling load 110. Therefore, the hydronic heating coil 180 may cause an increase a pressure drop of air flow between the fan section 132 and an intake section 184 of the central housing 114, which may reduce an operational efficiency of the HVAC system 100. Accordingly, embodiments of the HVAC system 100 discussed herein include the hydronic coil actuation system 102, which is configured to substantially remove the hydronic heating coil 180 from the flow path 118 while the HVAC system 100 is operating in the cooling mode or other modes when the hydronic heating coil 180 is not operating. The hydronic coil actuation system 102 may therefore reduce a pressure drop between the fan section 132 and the intake section 184 during operation of the HVAC system 100, which may enhance an operational efficiency of the HVAC system 100. As noted above, it should be appreciated that the hydronic coil actuation system 102 may also be configured for use with other heat exchangers or coils to be selectively positioned within or removed from the flow path 118.

Figure 6:
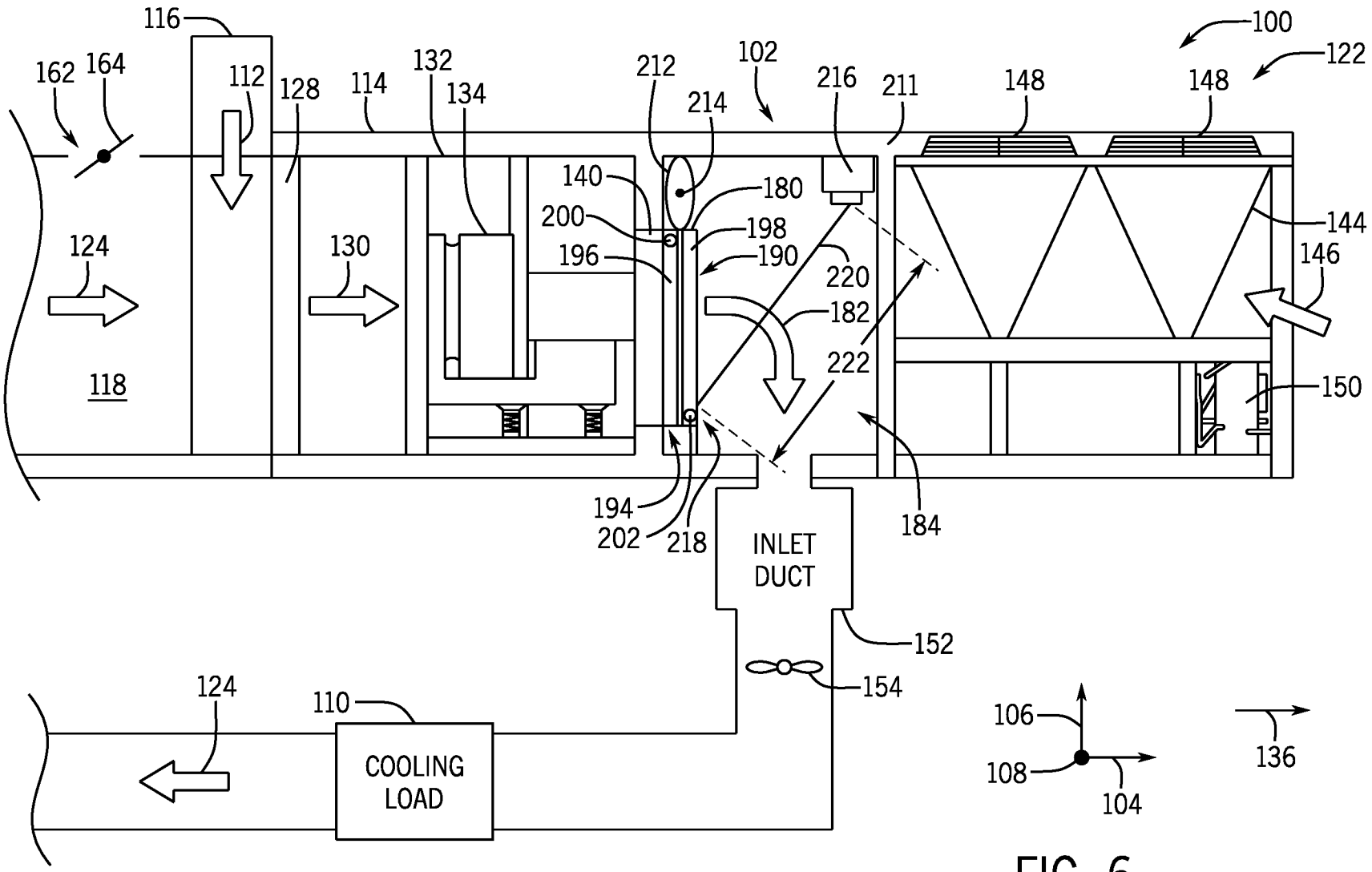
FIG. 6 is a schematic view of an embodiment of a heat exchanger actuation mechanism, illustrating a heat exchanger in an engaged position, in accordance with an aspect of the present disclosure.

With the foregoing in mind, FIG. 6 illustrates a schematic diagram of an embodiment of the downstream end portion 122 of the central housing 114. In the illustrated embodiment, the HVAC system 100 is operating in the heating mode, in which the evaporator 140 is inactive or non-operational, while a heated working fluid is circulated through the hydronic heating coil 180. Accordingly, the HVAC system 100 is configured to supply the heated air 182 to the cooling load 110 via the inlet duct 152. While the HVAC system 100 is operating in the heating mode, the hydronic heating coil 180 is disposed in a first position 190, or in a first orientation, in which the hydronic heating coil 180 is disposed within the flow path 118 of the central housing 114. For example, in the first position 190, the hydronic heating coil 180 may be oriented generally parallel to the evaporator 140 and substantially perpendicular to a flow direction of the supply air 130 along the flow path 118.

In some embodiments, the hydronic heating coil 180 is configured to engage with the evaporator 140 in the first position 190, such that the supply air 130 discharging from the fan section 132 is sequentially directed across a heat exchange area of the evaporator 140 and a heat exchange area of the hydronic heating coil 180. For example, the evaporator 140 and the hydronic heating coil 180 may each include a respective case that extends about a perimeter of the evaporator 140 or a perimeter of the hydronic heating coil 180. The cases of the evaporator 140 and the hydronic heating coil 180 may engage with one another, or physically contact one another, when the hydronic heating coil 180 is disposed in the first position 190. Accordingly, the engagement between the case of the evaporator 140 and the case of the hydronic heating coil 180 may mitigate a leakage of air between the heat exchange area of the evaporator 140 and the heat exchange area of the hydronic heating coil 180. In some embodiments, a gasket 194, such as foam, cork, rubber, or the like, may be coupled to the case of the hydronic heating coil 180 and/or the case of the evaporator 140. The hydronic heating coil 180 and the evaporator 140 may cooperatively compress the gasket 194 between their respective cases when the hydronic heating coil 180 is disposed in the first position 190. Accordingly, the gasket 194 may form a fluidic seal about a perimeter of the heat exchange area of the evaporator 140 and a perimeter of the heat exchange area of the hydronic heating coil 180, which may mitigate or substantially eliminate the discharge of air between the evaporator 140 and the hydronic heating coil 180.

The hydronic heating coil 180 includes an inlet manifold 196 and an outlet manifold 198, which include and inlet 200 an outlet 202, respectively. A plurality of tubes or channels may extend between the inlet manifold 196 and the outlet manifold 198 and form one or more coils or flow passages of the hydronic heating coil 180. Accordingly, the hydronic heating coil 180 may circulate the heating working fluid, such as steam, water, oil, or the like, from the inlet manifold 196 to the outlet manifold 198. The inlet 200 and the outlet 202 are fluidly coupled to a suitable fluid source, such as a boiler, which is configured to provide the heating working fluid to the hydronic heating coil 180. As described in greater detail herein, the inlet 200 and the outlet 202 may be coupled to the fluid source via flexible tubing or a flexible conduit, which enables the hydronic heating coil 180 to transition between the first position 190 and a second position 210, as shown in FIG. 7, without fluidly decoupling the hydronic heating coil 180 from the fluid source.

The hydronic heating coil 180 is rotatably coupled to a top panel 211 or other structural member of the central housing 114 via a hinge 212. As discussed in detail below, the hinge 212 enables the hydronic heating coil 180 to rotate about a rotational axis 214, which extends generally parallel to the lateral axis 108. Accordingly, the hydronic heating coil 180 may rotate between the first position 190 and the second position 210. The hydronic heating coil actuation mechanism 102 includes an actuator 216 coupled to the top panel 211 or other structural member of the central housing 114. The actuator 216 is configured to rotate the hydronic heating coil 180 between the first and second positions 190, 210. For example, the actuator 216 is coupled to the hydronic heating coil 180, or a case 218 of the hydronic heating coil 180, couple via a coupling member 220. A distal end of the coupling member 220 is coupled to the hydronic heating coil 180, or the case 218 of the hydronic heating coil 180, while a proximate end of the coupling member 220 is coupled to the actuator 216. The coupling member 220 may include a chain, a wire or cable, a rope, or any other suitable coupling that is configured to extend between the actuator 216 and the hydronic heating coil 180 and/or the case 218 of the hydronic heating coil 180. The actuator 216 is configured to selectively retrieve and release the coupling member 220, and thereby, rotate the hydronic heating coil 180 about the rotational axis 214.

For example, in some embodiments, the actuator 216 may include a chain drive actuator that includes the coupling member 220 and is configured to spool or unspool the coupling member 220 about a drum of the actuator 216. Accordingly, the actuator 216 may transition the hydronic heating coil 180 to the second position 210 by spooling the coupling member 220 about the drum or, in other words, decreasing an extension length 222 of the coupling member 220 between the hydronic heating coil 180 and the actuator 216. Conversely, the actuator 216 may unspool the coupling member 220 about the drum to increase the extension length 222 of the coupling member 220, and thus transition the hydronic heating coil 180 toward the first position 190. It should be noted that the actuator 216 is not limited to an actuator that is configured to move the hydronic heating coil 180 between the first and second positions 190, 210 by retrieving and releasing the coupling member 220. Rather, the actuator 216 may include any suitable actuator configured to couple to the hydronic heating coil 180 and rotate the hydronic heating coil 180 about the rotational axis 214 between the first and second positions 190, 210. For example, the actuator 216 may include, but is not limited to, a hydraulic actuator, a pneumatic actuator, or a threaded rod configured to engage with and induce movement of the hydronic heating coil 180, a mechanical linkage system, or other actuation system.

Figure 7:
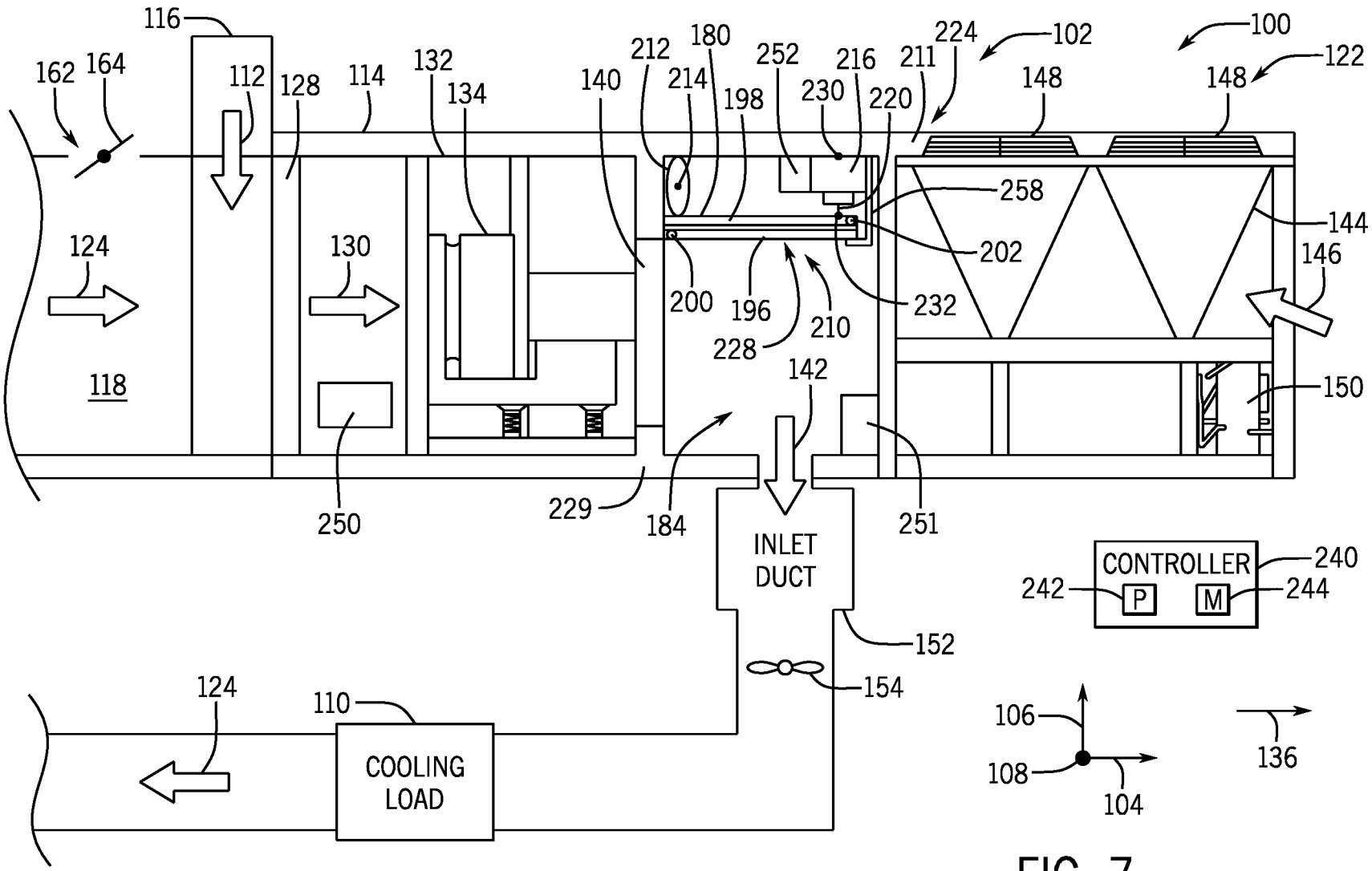
FIG. 7 is a schematic view of an embodiment of a heat exchanger actuation mechanism, illustrating the heat exchanger in a disengaged position, in accordance with an aspect of the present disclosure.

Turning now to FIG. 7, which is a schematic side view of an embodiment of the downstream end portion 122 of the central housing 114, illustrating the hydronic heating coil 180 in the second position 210. As shown in the illustrated embodiment, the hydronic heating coil 180 is oriented generally perpendicular to the evaporator 140 and substantially parallel to a flow direction of the supply air 130 along the flow path 118 in the second position 210. The hydronic heating coil 180 is thus disposed near an upper portion 224 of the central housing 114, such that the hydronic heating coil 180 is removed from the flow path 118 or substantially removed from the flow path 118. In other words, substantially no air may flow across the heat exchange area of the hydronic heating coil 180 when the hydronic heating coil 180 is in the second position 210. As a result, the hydronic heating coil 180 generates a marginal or substantially negligible pressure drop along the flow path 118 in the second position 210. In some embodiments, a lower surface 228 of the hydronic heating coil 180 defines a portion of the flow path 118 when the hydronic heating coil 180 is disposed in the second position 210. That is, the lower surface 228 defines an upper boundary of the flow path 118, thereby enabling the flow path 118 to extend between the lower surface 228 of the hydronic heating coil 180 and a bottom wall 229 of the central housing 114. Accordingly, conditioned air 142 discharging from the evaporator 140 may flow along the flow path 118 beneath the hydronic heating coil 180, between the lower surface 228 and the bottom wall 229, and toward the inlet duct 152.

As noted above, flexible tubing or a flexible conduit fluidly couple the inlet 200 and outlet 202 of the hydronic heating coil 180 to a heated fluid source, such as the boiler. A length of the flexible tubing may be sized to enable the hydronic heating coil 180 to transition between the first and second positions 190, 210 without restricting movement of the hydronic heating coil 180 during the transition between positions. Accordingly, the hydronic heating coil 180 may remain coupled to the heated fluid source in the first position 190, in the second position 210, and while transitioning between the first position 190 and the second position 210.

In some embodiments, a mounting point 230 of the actuator 216 on the top panel 211 and a mounting point 232 of the coupling member 220 on the hydronic heating coil 180 may be oriented generally collinearly with one another with respect to the vertical axis 106 when the hydronic heating coil 180 is disposed in the second position 210. Accordingly, the coupling member 220 may extend generally perpendicular to the hydronic heating coil 180, which may minimize or substantially eliminate lateral strain on the hydronic heating coil 180 along the longitudinal axis 104 while the hydronic heating coil 180 is in the second position 210. However, in other embodiments, the mounting point 230 of the actuator 216 and the mounting point 232 of the coupling member 220 may be disposed along any suitable portion of the top panel 211 and along any suitable portion of the hydronic heating coil 180, respectively.

In some embodiments, the HVAC system 100 may include a controller 240, or a plurality of controllers, which may be used in addition to, or in lieu of, the control panel 82 to control certain components of the hydronic coil actuation mechanism 102 and/or the HVAC system 100. For example, one or more control transfer devices, such as wires, cables, wireless communication devices, and the like, may communicatively couple the exhaust air damper 164, the one or more fans 134, the actuator 216, or any other components of the hydronic coil actuation mechanism 102 and/or the HVAC system 100 to the controller 240. The controller 240 may include a processor 242, such as a microprocessor, which may execute software for controlling the components of the hydronic coil actuation mechanism 102 and/or the HVAC system 100. Moreover, the processor 242 may include multiple microprocessors, one or more "general-purpose" microprocessors, one or more special-purpose microprocessors, and/or one or more application specific integrated circuits (ASICS), or some combination thereof.

For example, the processor 242 may include one or more reduced instruction set (RISC) processors. The controller 240 may also include a memory device 244 that may store information such as control software, look up tables, configuration data, and so forth. The memory device 244 may include a volatile memory, such as random access memory (RAM), and/or a nonvolatile memory, such as read-only memory (ROM). The memory device 244 may store a variety of information and may be used for various purposes. For example, the memory device 244 may store processor-executable instructions including firmware or software for the processor 242 execute, such as instructions for controlling the components of the hydronic coil actuation mechanism 102 and/or the HVAC system 100. In some embodiments, the memory device 244 is a tangible, non-transitory, machine-readable-medium that may store machine-readable instructions for the processor 242 to execute. The memory device 244 may include ROM, flash memory, a hard drive, or any other suitable optical, magnetic, or solid-state storage medium, or a combination thereof. The memory device 244 may store data, instructions, and any other suitable data.

As noted above, the actuator 216 may be communicatively coupled to the controller 240, which is configured to instruct the actuator 216 to position the hydronic heating coil 180 in the first position 190 or in the second position 210 based on certain operational parameters of the HVAC system 100. For example, the HVAC system 100 may include one or more temperature sensors 250 that are configured to measure a temperature of the supply air 130 entering the fan section 132, and thus, provide the controller 240 with feedback indicative of an actual temperature of the supply air 130. The controller 240 may compare the actual temperature of the supply air 130 to a target temperature of the supply air 130, which may be previously determined and stored in the memory device 244 of the controller 240.

For example, the target temperature may be provided to the controller 240 from the control panel 82, a thermostat of the HVAC system 100, or via any other suitable user interface of the HVAC system 100. If the actual temperature of the supply air 130 is below the target temperature by a threshold amount, the controller 240 may instruct the actuator 216 to position the hydronic heating coil 180 in the first position 190, such that the HVAC system 100 may operate in a heating mode by circulating heated working fluid through the hydronic heating coil 180. Accordingly, the hydronic heating coil 180 may heat the supply air 130, and the heated air 182 may be directed toward the cooling load 110 at a temperature greater than or substantially equal to the target temperature. Conversely, if the temperature of the supply air 130 is above the target temperature by a threshold amount, the controller 240 may instruct the actuator 216 to position the hydronic heating coil 180 in the second position 210, such that the HVAC system 100 may operate in a cooling mode by circulating refrigerant through the evaporator 140. Therefore, the evaporator 140 may cool the supply air 130, and the cooled air 142 may be directed toward the cooling load 110 at a temperature lower than or substantially equal to the target temperature. The controller 240 may thus maintain a desired temperature value within the cooling load 110 by transitioning the HVAC system 100 between the heating mode and the cooling mode and, accordingly, transitioning the hydronic heating coil 180 between the first position 190 and the second position 210, respectively.

It should be noted that, in other embodiments, the controller 240 may instruct the actuator 216 to transition the hydronic heating coil 180 between the first position 190 and the second position 210 in response to feedback received from any other suitable sensors of the HVAC system 100. For example, the controller 240 may instruct the actuator 216 to move the hydronic heating coil 180 in response to feedback from one or more additional sensors 251 measuring a temperature of the cooled air 142 and/or a temperature of the heated air 182, a temperature of the exhaust air 124, a flow rate of refrigerant circulating through the evaporator 140, a flow rate of working fluid circulating through the hydronic heating coil 180, or any other suitable parameter of the HVAC system 100. In other embodiments, the controller 240 may instruct the actuator 216 to transition the hydronic heating coil 180 between the first position 190 and the second position 210 in response to other feedback or input, such as an operating mode of the HVAC system 100.

In some embodiments, the hydronic coil actuation mechanism 102 includes a position sensor 252 that is configured to provide the controller 240 with feedback indicative of a position of the hydronic heating coil 180. The position sensor 252 may be integrated with the actuator 216 or may include a separate sensor that is disposed, for example, adjacent the top panel 211 of the central housing 114. The position sensor 252 may enable the controller 240 to determine when to enable or disable operation of the actuator 216. For example, the controller 240 may instruct the actuator 216 to transition the hydronic heating coil 180 from the first position 190 to the second position 210 after receiving feedback from the temperature sensors 250 that the actual temperature of the supply air 130 is above the target temperature. The controller 240 may monitor rotational movement of the hydronic heating coil 180 about the rotation axis 214 while the hydronic heating coil 180 transitions from the first position 190 to the second position 210. The controller 240 may stop operation of the actuator 216 after receiving feedback from the position sensor 252 indicating that the hydronic heating coil 180 has transitioned to the second position 210.

As discussed in greater detail below, in some embodiments, the hydronic coil actuation mechanism 102 includes a support bracket 258 that is configured to block rotational movement of the hydronic heating coil 180 when the hydronic heating coil is disposed in the second position 210. The support bracket 258 may ensure that the hydronic heating coil 180 does not transition to the first position 190, for example, when the HVAC system 100 is operating in the cooling mode or when a service technician is performing maintenance operations within the intake section 184 and beneath the hydronic heating coil 180.

Figure 8:
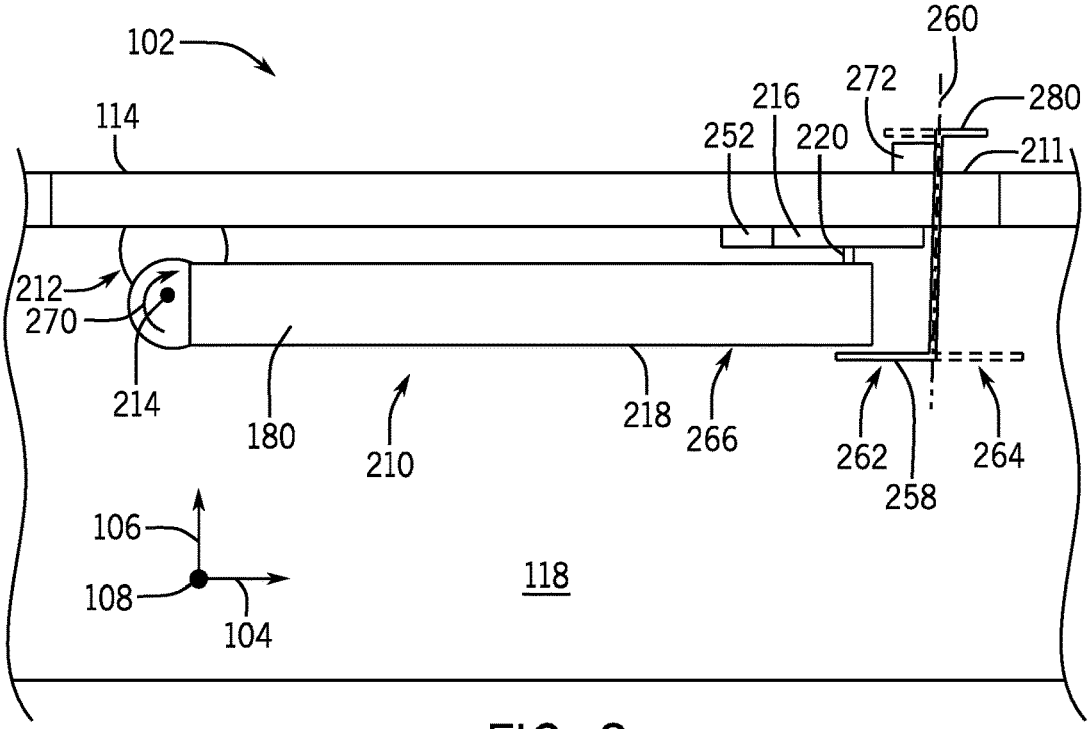
FIG. 8 is a schematic view of an embodiment of a heat exchanger actuation mechanism having a support bracket, in accordance with an aspect of the present disclosure.

FIG. 8 is a schematic diagram of an embodiment of the hydronic coil actuation mechanism 102. As shown in FIG. 8, the support bracket 258 extends from the top panel 211 of the central housing 114. In other embodiments, the support bracket 258 may couple to and/or extend from another structural member of the central housing 114. The support bracket 258 may be configured to rotate about a centerline 260 extending generally parallel to the vertical axis 106 between a first position 262, or an engaged position, and a second position 264, or a disengaged position. The support bracket 258 may extend beneath a lower face 266 of the hydronic heating coil 180 in the first position 262, and thus, block the hydronic heating coil 180 from rotating in a clockwise direction 270 about the rotational axis 214. Additionally or otherwise, the support bracket 258 may engage with any suitable portion of the case 218 of the hydronic heating coil 180, such that the support bracket 258 may block rotational motion of the hydronic heating coil 180 when the support bracket 258 is in the first position 262. Conversely, the support bracket 258 enables the hydronic heating coil 180 to rotate about the rotational axis unobstructed when the support bracket 258 is disposed in the second position 264.

In some embodiments, the support bracket 258 may be coupled to a support actuator 272, which is configured to transition the support bracket 258 between the first and second positions 262, 264. In certain embodiments, the support actuator 272 is communicatively coupled to the controller 240, such that the controller 240 may instruct the support actuator 272 to transition the support bracket 258 from the first position 262 to the second position 264, or vice versa. For example, as noted above, the controller 240 may monitor a position of the hydronic heating coil 180, such as through the position sensor 252 or an internal sensor disposed within the actuator 216, while the hydronic heating coil 180 transitions from the first position 190 to the second position 210. After the controller 240 determines that the hydronic heating coil 180 has reached the second position 210, the controller 240 may instruct the support actuator 272 to move the support bracket 258 from the second position 264 to the first position 262. Conversely, if the controller 240 receives a signal to transition the hydronic heating coil 180 from the second position 210 to the first position 190, the controller 240 may instruct the support bracket 258 to move from the first position 262 to the second position 264 and subsequently instruct the actuator 216 to lower the hydronic heating coil 180 toward the first position 190. Additionally or alternately, the controller 240 may instruct the support actuator 272 to transition the support bracket 258 between the first and second positions 262, 264 based on any other suitable operating parameter of the hydronic coil actuation system 102 and/or HVAC system 100. In certain embodiments, the controller 240 may instruct the support actuator 272 to position the support bracket 258 in the first position 262 after receiving a signal to operate the HVAC system 100 in the cooling mode and may instruct the support actuator 272 to position the support bracket 258 in the second position 264 after receiving a signal to operate the HVAC system 100 in the heating mode.

It should be noted that, in certain embodiments, the support bracket 258 may be coupled to an external handle 280 in addition to, or in lieu of, the support actuator 272. The external handle 280 may enable an operator, such as a service technical performing maintenance operations to the HVAC system 100, to manually transition the support bracket 258 between the first position 262 and the second position 246 position. In some embodiments, actuating the handle 280 may temporarily decouple the support bracket 258 from the support actuator 272. Accordingly, the handle 280 may be used to override the support actuator 272 and ensure that the support bracket 258 remains disposed in the first position 262 until the operator manually repositions the support bracket 258 from the first position 262 to the second position 264 via the handle 280. Although the support bracket 258 is shown as extending from the top panel 211 of the central housing 114 in the illustrated embodiment of FIG. 8, it should be noted that the support bracket 258 may extend from any other suitable section or portion of the central housing 114.

Figure 9:
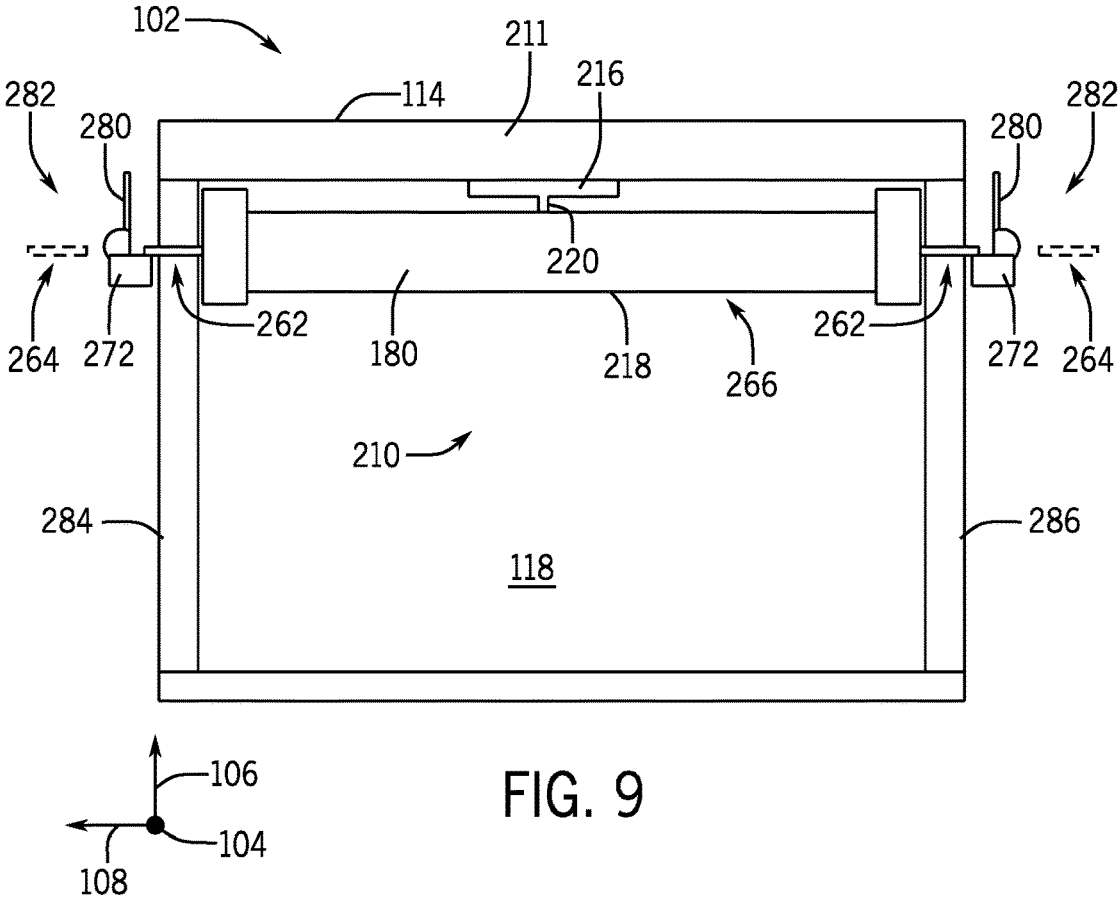
FIG. 9 is a cross-sectional schematic view of an embodiment of a heat exchanger actuation mechanism, in accordance with an aspect of the present disclosure.

For example, as shown in the illustrated embodiment of FIG. 9, the support bracket 258 may include a pair of support brackets 282 that extend from side panels 284, 286 of the central housing 114 and engage with the hydronic heating coil 180. Although the support bracket 258 has been described as rotating between the first position 262 and the second position 264, the support bracket 258 may also translate axially, or in another other suitable direction, between the first and second positions 262, 264. For example, as shown in the illustrated embodiment, the support brackets 282 may translate axially along the lateral axis 108 between the first position 262 and the second position 264, and thus, engage or disengage with the hydronic heating coil 180 and/or the case 218 of the hydronic heating coil 180.

Figure 10:
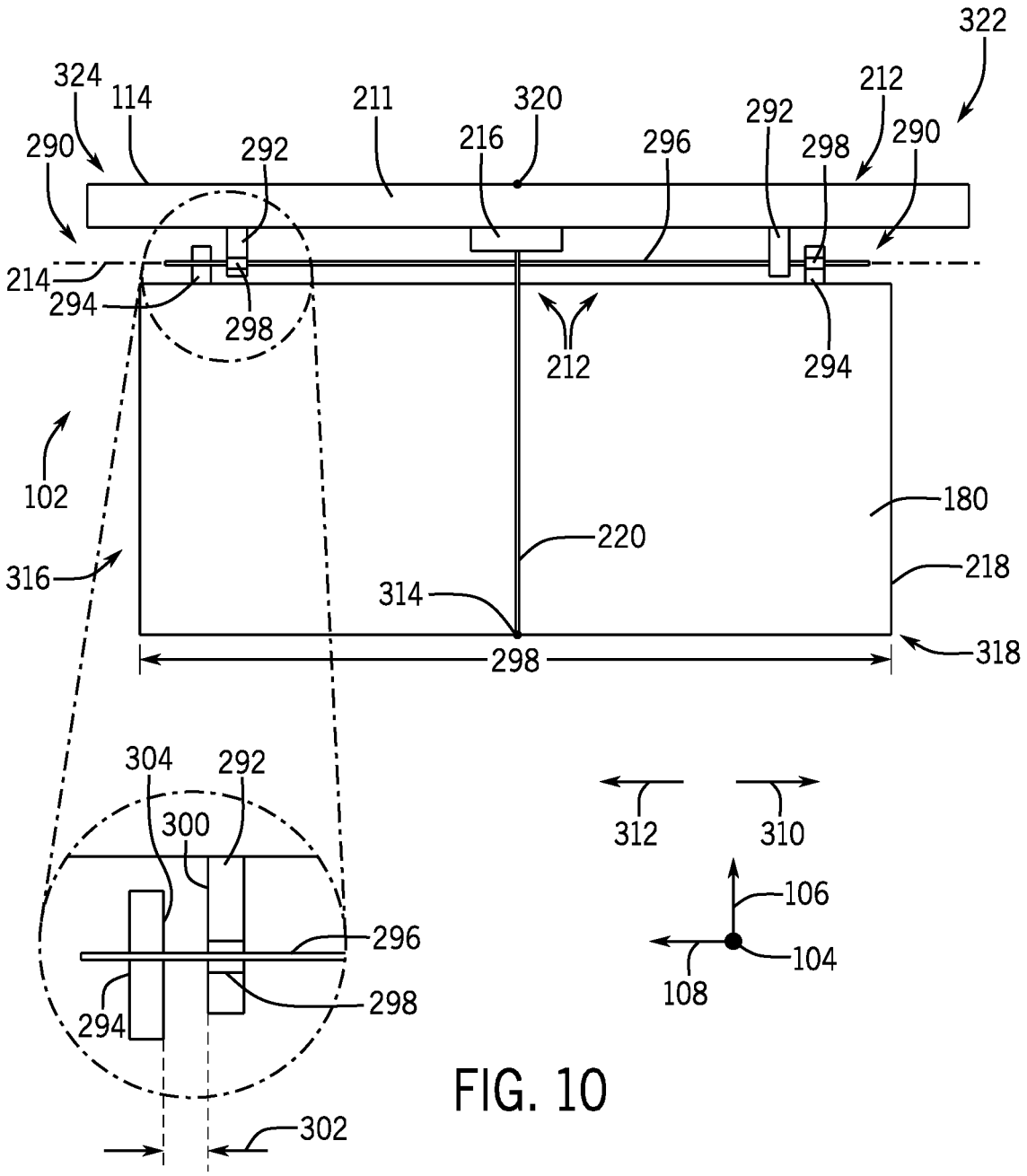
FIG. 10 is a front schematic view of an embodiment of a heat exchanger actuation mechanism, in accordance with an aspect of the present disclosure.

FIG. 10 is a schematic diagram of an embodiment of the hydronic coil actuation mechanism 102. As noted above, the hydronic coil actuation mechanism 102 includes the hinge 212, which enables the hydronic heating coil 180 to rotate about the rotational axis 214, while substantially blocking movement of the hydronic heating coil along the longitudinal, vertical, and lateral axes 104, 106, 108. In the illustrated embodiment, the hinge 212 includes a pair of hinge assemblies 290, which are disposed on opposing sides of the hydronic heating coil 180 and rotatably couple the hydronic heating coil 180 to the top panel 211 of the central housing 114. Each hinge assembly 290 includes an upper guide 292, which is coupled to the top panel 211, and a lower guide 294, which is coupled to the hydronic heating coil 180 and/or the case 218 of the hydronic heating coil 180. A rod 296 is configured to extend between the hinge assemblies 290 and along a width 298 of the hydronic heating coil 180. In the illustrated embodiment, each of the lower guides 294 is fixedly coupled to the rod 296, while each of the upper guides 292 is rotatably coupled to the rod 296 via a respective bearing 299 disposed within each of the upper guides 292. Accordingly, the rod 296, the lower guides 294, and the hydronic heating coil 180 may rotate about the rotational axis 214, relative to the upper guides 292. However, it should be noted that in other embodiments, an additional bearing may be disposed within each of the lower guides 294, such that the rod 296 may rotate independent of both the upper guides 292 and the lower guides 294.

In any case, the lower guides 294 are both disposed adjacent an outer surface 300 of the upper guides 292, relative to a center of the hydronic heating coil 180, as shown in the illustrated embodiment. A gap 302 disposed between an inner surface 304 of the lower guides 292 and the outer surface 300 of the upper guides 292, relative to a center of the hydronic heating coil 180, may mitigate frictional resistance between the upper and lower guides 292, 294 during operation of the hinge assemblies 290. It should be noted that the gap 302 may be relatively small, such that lateral movement of the lower guides 294 and the hydronic heating coil 180 along the rotational axis 214 is substantially blocked. For example, the hinge assemblies 290 block the hydronic heating coil 180 from moving in a right direction 310 or a left direction 312 by a distance greater than the gap 302. Accordingly, the hinge assemblies 290 may substantially block lateral movement of the hydronic heating coil 180 relative to the central housing 114.

Although the coupling member 220 is shown as coupling to the hydronic heating coil 180 along a midpoint 314 of the width 298 of the hydronic heating coil 180, it should be noted that the coupling member 220 may be coupled to the hydronic heating coil 180 along any suitable portion of the width 298. For example, the coupling member 220 may couple to a left-end portion 316 of the hydronic heating coil 180 or couple to a right-end portion 318 of the hydronic heating coil 180. Similarly, the actuator 216 may couple to the top panel 211 near a midpoint 320 of the top panel 211, near a right-end portion 322 of the top panel 211, near a left-end portion 324 of the top panel 211, or any position therebetween.

Figure 11:
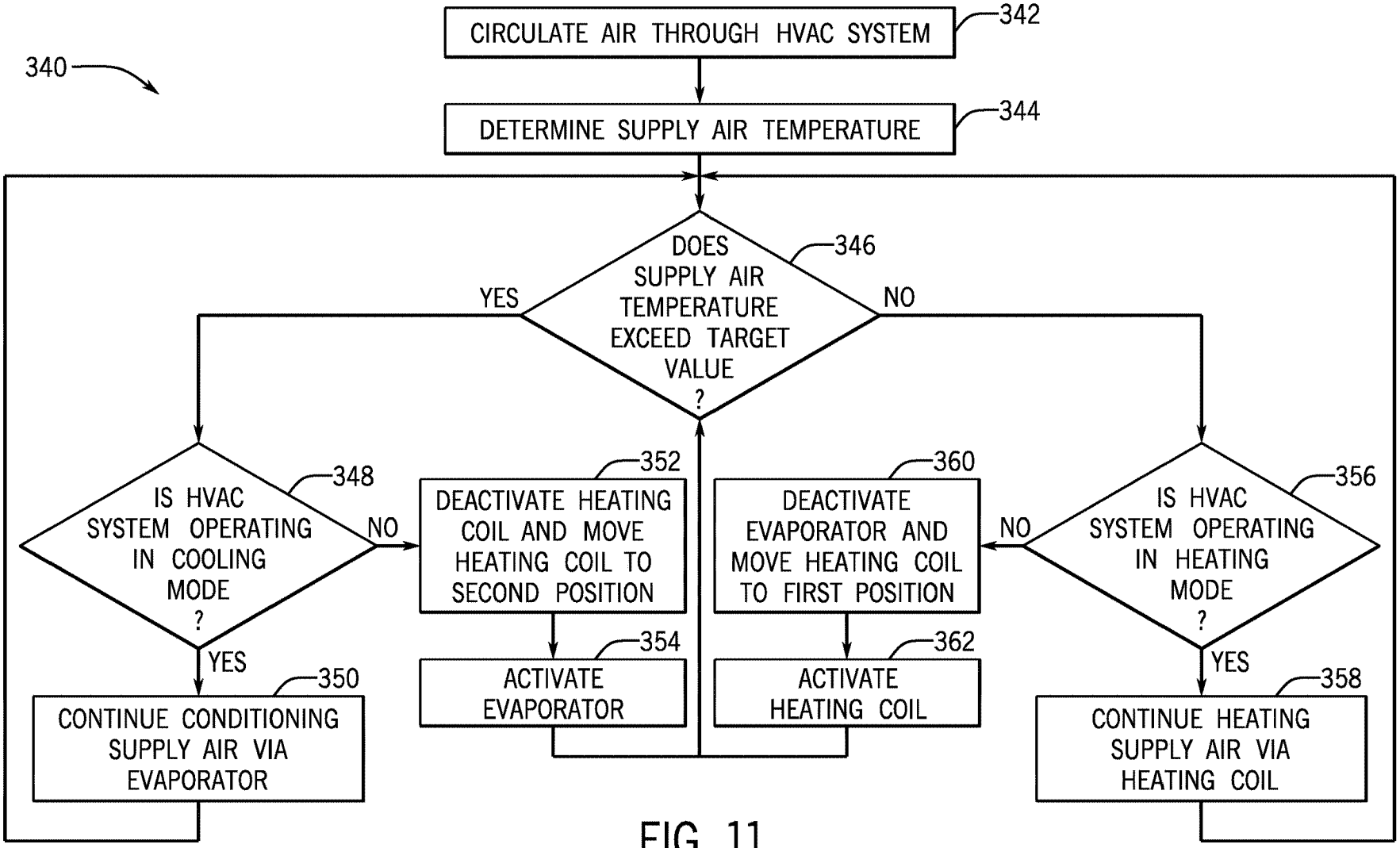
FIG. 11 is an embodiment of a method of operating a heat exchanger actuation mechanism, in accordance with an aspect of the present disclosure.

With the foregoing in mind, FIG. 11 is block diagram of an embodiment of a method 340 of operating the hydronic coil actuation mechanism 102. The following discussion references element number used throughout FIGS. 1-10. It should be noted that the method 340 may be performed by the control panel 82, the controller 240, or any other suitable controller of the hydronic coil actuation mechanism 102 and/or the HVAC system 100. The method 340 may begin with circulating a flow of air, such as the supply air 130, through the HVAC system 100, as indicated by process block 342. For example, the one or more fans 134 of the fan section 132 may circulate a mixture of the outdoor air 112 and a portion of the exhaust air 124 through the cooling load 110 and thereby maintain a desired air quality and air temperature within the cooling load 110. The controller 240 determines an actual temperature of the supply air 130 via feedback provided by the one or more temperature sensors 250, as indicated by process block 344. The controller 240 compares the actual temperature of the supply air 130 to a target temperature of the supply air 130, as indicated by decision block 346.

If the actual temperature of the supply air 130 is above the target temperature by a threshold amount, the controller 240 evaluates whether the HVAC system 100 is operating in a cooling mode, as indicated by decision block 348. For example, the controller 240 may be communicatively coupled to one or more flow rate sensors that are configured to measure a flow rate of refrigerant through the evaporator 140 and a flow rate of the heated working fluid through the hydronic heating coil 180. The controller 240 may determine that the HVAC system 100 is operating in the cooling mode if a flow rate of refrigerant flowing through the evaporator 140 is non-zero, while a flow rate of the heated working fluid flowing through the hydronic heating coil 180 is substantially zero. Conversely, the controller 240 may determine that the HVAC system 100 is operating in the heating mode if a flow rate of the refrigerant is substantially zero while a flow rate of the heated working fluid is non-zero. Additionally or otherwise, the controller 240 may determine whether the HVAC system 100 is operating in the cooling mode or the heating mode by monitoring any other suitable operating parameters of the HVAC system 100, such as a position of the hydronic heating coil 180. In further embodiments, the controller 240 may receive feedback indicative of an operational mode of the HVAC system 100 from the control device 16, a central controller of the cooling load 110, or any other suitable controller associated with the HVAC system 100.

In any case, if the controller 240 determines that the HVAC system 100 is already operating in the cooling mode, the controller 240 may continue operating the evaporator 140 and enable the evaporator 140 to further condition the supply air 130 circulating through the HVAC system 100 and the cooling load 110, as indicated by process block 350. For example, the controller 240 may instruct one or more flow generating devices, such as valves, pumps, or the like, to circulate refrigerant between the evaporator 140 and the vapor compression system 72. Accordingly, the refrigerant within the evaporator 140 may absorb thermal energy from the supply air 130, and thus, discharge the cooled air 142, which is directed toward the cooling load 110. Therefore, the controller 240 may operate to ensure that an air temperature of the supply air 130 is decreased and approaches the target air temperature. In this way, the HVAC system 100 may substantially approach or maintain a target air temperature within the cooling load 110.

If the controller 240 determines that the HVAC system 100 is not operating in the cooling mode, such as when the HVAC system 100 is operating in the heating mode, the controller 240 may instruct the HVAC system 100 to deactivate operation of the hydronic heating coil 180 and instruct the actuator 216 to move the hydronic heating coil 180 to the second position 210, as indicated by process block 352. In some embodiments, the controller 240 may instruct the support actuator 272 to subsequently move the support bracket 258 to the first position 262, and thus, maintain the hydronic heating coil 180 in the second position 210. The controller 240 activates operation of the evaporator 140, as indicated by process block 354, such that the HVAC system 100 may condition the supply air 130. Accordingly, the evaporator 140 may decrease an actual temperature of the supply air 130, such that the actual temperature of the supply air 130 and/or the air temperature of the cooling load 110 may approach the target temperature. Because the hydronic coil actuation mechanism 102 substantially removes the hydronic heating coil 180 from the flow path 118 when the HVAC system 100 is operating in the cooling mode, substantially no air discharging from the evaporator 140 is directed across the heat exchange area of the hydronic heating coil 180. Accordingly, the hydronic coil actuation mechanism 102 may reduce a pressure drop between the fan section 132 and the intake section 184 of the central housing 114, and thus, enhance an operation efficiency of the HVAC system 100. The controller 240 continues to monitor a temperature of the supply air 130, as indicated by the decision block 346.

If the controller 240 determines that the actual temperature of the supply air 130 does not exceed the target temperature by the threshold amount, the controller 240 determines whether the actual temperature of the supply air 130 is below the target temperature by the threshold amount. For clarity, the threshold amount may include a predetermined temperature value or a range of predetermined temperature values. For example, in some embodiments, the threshold amount may be between about 0.5 degrees Celsius and about 2 degrees Celsius, between about 1 degree Celsius and about 3 degrees Celsius, or between about 2 degrees Celsius and about 5 degrees Celsius. However, in other embodiments, the threshold amount may include a temperature value that is less than 0.5 degrees Celsius or greater than 5 degrees Celsius. Regardless, if the actual temperature of the supply air 130 is not above or below the target temperature by the threshold amount, the controller 240 may not adjust an operational mode of the HVAC system 100 and may continue to operate the HVAC system 100 in the current mode of operation. That is, if the HVAC system 100 is operating in the cooling mode or the heating mode, and the actual temperature of the supply air 130 does not deviate from the target temperature by the threshold amount, the controller 240 continues to operate the HVAC system 100 in the current operating mode. If the controller 240 determines that the actual temperature of the supply air 130 falls below the target temperature by the threshold amount, the controller 240 subsequently determines whether the HVAC system 100 is operating in the heating mode, as indicated by decision block 356.

If the HVAC system 100 is operating in the heating mode, the controller 240 continues operating the hydronic heating coil 180, as indicated by process block 358, such that the hydronic heating coil 180 may heat the supply air 130. If the controller 240 determines that the HVAC system 100 is not operating in the heating mode, such as when the HVAC system 100 is operating in the cooling mode, the controller 240 deactivates operation of the evaporator 140 and instructs the actuator 216 to move the hydronic heating coil 180 to the first position 190, as indicated by process block 360. Accordingly, the hydronic coil actuation mechanism 102 may position the hydronic heating coil 180 within the flow path 118, such that the supply air 130 discharging from the fan section 132 is directed across the heat exchange area of the hydronic heating coil 180. As indicated by decision block 362, the controller 240 subsequently activates operation of the hydronic heating coil 180 by, for example, instructing one or more flow generating devices to circulate a heated working fluid through the hydronic heating coil 180. Accordingly, the HVAC system 100 may direct the heated air 182 to the cooling load 110, and thus, cause an air temperature within the cooling load 110 to approach or be maintained at a target air temperature.

Although the controller 240 has been described as operating the hydronic coil actuation system 102 and the HVAC system 100 based on a measured actual temperature of the supply air 130, it should be noted that the controller 240 may control operation of the hydronic coil actuation system 102 and/or the HVAC system 100 based on any other suitable operational parameter or combination of operational parameters of the hydronic coil actuation system 102 and/or the HVAC system 100. These operational parameters may be measured by the one or more additional sensors 251 or any other sensors disposed within the HVAC system 100 or externally of the HVAC system 100. For example, the controller 240 may control operation of the hydronic coil actuation system 102 and/or the HVAC system 100 based on feedback from the one or more additional sensors 251 indicative of a temperature of the outdoor air 112, a temperature of the exhaust air 124, a temperature of the conditioned and/or heated air 142, 182, an air temperature within the cooling load 110, an operating mode of the HVAC system 100, a flow rate of refrigerant circulating through the evaporator 140, a flow rate of the heated working fluid circulating through the hydronic heating coil 180, or any other suitable operational parameters of the HVAC system 100.

In some embodiments, the controller 240 may monitor any combination of the aforementioned operational parameters and instruct the hydronic coil actuation system 102 to transition the hydronic heating coil 180 from the first position 190 to the second position 210, or vice versa, when one or more of the operational parameters deviates from a respective target value by a threshold amount. That is, the controller 240 operates the hydronic coil actuation system 102 when a measured operational parameter, or a combination of measured operational parameters, exceeds or falls below a respective target value by a threshold amount. As noted above, in some embodiments, the threshold amount may include a predetermined value that is stored, for example, in the memory device 244 of the controller 240. In certain embodiments, the threshold amount may include a predetermined percentage of a target value of the operational parameter under observation. For example, the threshold amount may include 2%, 5%, 10%, 15%, or more than 15% of the target value of the operational parameter. However, it should be noted that in certain embodiments, the threshold amount may include a percentage of the target value that is less than 2%. Regardless, the controller 240 may control operation of the hydronic coil auction system 102 in accordance with the method 340 in response to a determination that an operational parameter of the HVAC system 100, or a plurality of operational parameters of the HVAC system 100, deviate from a predetermined target value by a threshold amount.

Technical effects of the hydronic coil actuation system 102 include improved efficiency of the HVAC system 100 by removing the hydronic heating coil 180 from the flow path 118 during certain operational periods of the HVAC system 100, such as when the HVAC system 100 is operating in a cooling mode. The hydronic coil actuation system 102 may also enable positioning of the hydronic heating coil 180 in an orientation that may facilitate maintenance operations on the evaporator 140 and/or the hydronic heating coil 180. For example, when the hydronic heating coil 180 is disposed in the second position 210, a service technician may obtain access certain portions of the evaporator 140 and/or the hydronic heating coil 180 that are inaccessible while the hydronic heating coil 180 is disposed in the first position 190. Accordingly, the hydronic coil actuation system 102 reduce a time period during which the maintenance operations on the HVAC system 100 are performed, which may mitigate an inactive operational period of the HVAC system 100.

As discussed above, the aforementioned embodiments of the hydronic coil actuation mechanism 102 may be used on the HVAC unit 12, the residential heating and cooling system 50, the HVAC system 100, or in any other suitable HVAC systems. Additionally, the specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A heating, ventilation, and/or air conditioning (HVAC) system, comprising:

a heating coil; and an actuation system configured to couple to the heating coil, wherein the actuation system comprises an actuator and a tether configured to extend between the actuator and the heating coil, wherein the actuator is configured to retrieve and release the tether to rotatably position the heating coil in a first orientation crosswise to an airflow path in a heating mode and to rotatably position the heating coil in a second orientation substantially removed from the airflow path in a cooling mode.

2. The HVAC system of claim 1, wherein the tether comprises a chain, wherein a distal end of the chain is coupled to a case of the heating coil.

3. The HVAC system of claim 1, wherein the heating coil is configured to circulate a heated water flow during the heating mode.

4. The HVAC system of claim 1, comprising an enclosure having the heating coil and defining the airflow path, wherein the heating coil is rotatably coupled to the enclosure via a hinge assembly, wherein the hinge assembly comprises:

an upper guide coupled to the enclosure;

a lower guide coupled to the heating coil; and a rod extending through the upper guide and the lower guide, wherein the rod is fixedly coupled to the lower guide and rotatably coupled to the upper guide.

5. The HVAC system of claim 1, wherein the actuation system comprises a controller communicatively coupled to the actuator, wherein the controller is configured to actuate the actuator based on feedback indicative of an operating parameter of the HVAC system.

6. The HVAC system of claim 5, wherein the feedback indicative of the operating parameter is provided by a sensor, and wherein the operating parameter comprises a temperature of an exhaust air flow within the airflow path, a temperature of an outdoor air flow within the airflow path, a temperature of a conditioned air flow within the airflow path, a flow rate of heated water circulating through the heating coil, a flow rate of refrigerant circulating through an evaporator within the airflow path, or a combination thereof.

7. The HVAC system of claim 5, comprising an enclosure defining the airflow path and having the heating coil and the actuation system, wherein the actuator is coupled to the enclosure.

8. The HVAC system of claim 1, wherein the heating coil comprises an inlet configured to receive a heated water flow from a heated water source and an outlet configured to discharge the heated water flow to the heated water source, and wherein the inlet and the outlet are fluidly coupled to the heated water source via flexible conduits.

9. The HVAC system of claim 1, comprising an evaporator disposed adjacent the heating coil within the airflow path in the first orientation, wherein the heating coil is oriented generally parallel to the evaporator in the first orientation.

10. The HVAC system of claim 9, wherein a case of the heating coil is configured to engage with a case of the evaporator in the first orientation, and wherein the HVAC system comprises a gasket coupled to the case of the heating coil, the case of the evaporator, or both.

11. The HVAC system of claim 1, comprising an enclosure defining the airflow path and having the heating coil, wherein the enclosure comprises a support bracket, wherein the support bracket is actuatable to retain the heating coil in the second orientation in the cooling mode.

12. The HVAC system of claim 1, wherein the HVAC system comprises a rooftop unit having the heating coil and the actuation system.

13. A heating, ventilation, and/or air conditioning (HVAC) system, comprising:

a heating coil;

an actuation system coupled to the heating coil and configured to rotate the heating coil; and a controller configured to regulate operation of the actuation system to rotate the heating coil between a first orientation and a second orientation based on a comparison of an operating parameter of the HVAC system to a target value associated with the operating parameter, wherein the heating coil is disposed within an airflow path of the HVAC system in the first orientation, and wherein the heating coil is substantially removed from the airflow path in the second orientation.

14. The HVAC system of claim 13, wherein the controller is configured to regulate operation of the actuation system to rotate the heating coil between the first orientation and the second orientation in response to a determination that a value associated with the operating parameter deviates from the target value associated with the operating parameter by a threshold amount.

15. The HVAC system of claim 14, wherein the threshold amount comprises a predetermined percentage of the target value of the operating parameter.

16. The HVAC system of claim 14, wherein the controller is configured to receive feedback indicative of the value of the operating parameter from a sensor, and wherein the operating parameter comprises a temperature of an air flow within the airflow path, a temperature within a thermal load configured to receive the airflow, a temperature of ambient air exterior to the HVAC system, a flow rate of heated water circulating through the heating coil, a flow rate of refrigerant circulating through an evaporator disposed within the airflow path, or a combination thereof.

17. The HVAC system of claim 13, wherein the actuation system comprises an actuator configured to retrieve and release a tether coupled to and extending between the actuator and the heating coil to rotate the heating coil, wherein the controller is communicatively coupled to the actuator and configured to instruct the actuator to transition the heating coil from the first orientation to the second orientation when a value associated with the operating parameter exceeds the target value associated with the operating parameter by a threshold amount.

18. The HVAC system of claim 17, wherein the controller is configured to instruct the actuator to transition the heating coil from the second orientation to the first orientation when the value associated with the operating parameter falls below the target value associated with the operating parameter by the threshold amount.

19. The HVAC system of claim 13, comprising an enclosure defining the airflow path and having the heating coil, and comprising a support bracket coupled to the enclosure, wherein the support bracket is movable between a first position and a second position, wherein the support bracket, in the first position, is configured to retain the heating coil in the second orientation, and wherein the support bracket is configured to enable rotational movement of the heating coil in the second position.

20. The HVAC system of claim 19, comprising an actuator coupled to the support bracket and configured to transition the support bracket between the first position and the second position, wherein the controller is communicatively coupled to the actuator and is configured to instruct the actuator to transition the support bracket between the first position and the second position based on the operating parameter of the HVAC system.

21. The HVAC system of claim 20, wherein the controller is configured to instruct the actuator to position the support bracket in the first position upon a determination that the actuation system has fully transitioned the heating coil to the second orientation.

22. The HVAC system of claim 13, comprising an evaporator disposed within the airflow path, wherein the controller is configured to:

suspend operation of the evaporator and initiate operation of the heating coil when the heating coil is transitioned to the first orientation; and initiate operation of the evaporator and suspend operation of the heating coil when the heating coil has transitioned to the second orientation.

23. The HVAC system of claim 13, wherein the HVAC system comprises a rooftop unit.

24. A rooftop unit for a heating, ventilation, and/or air conditioning (HVAC) system, comprising:

an enclosure defining an airflow path through the rooftop unit;

an evaporator disposed within the enclosure and within the airflow path;

a heating coil rotatably coupled to the enclosure and configured to transition between a first orientation and a second orientation, wherein the heating coil is disposed within the airflow path in the first orientation and the heating coil is substantially removed from the airflow path in the second orientation; and an actuator disposed within the enclosure and coupled to the heating coil via a tether, wherein the actuator is configured to retrieve and release the tether to transition the heating coil between the first orientation and the second orientation.

25. The rooftop unit of claim 24, comprising a controller communicatively coupled to the actuator and a sensor, wherein the sensor is configured to provide the controller with feedback indicative of an operating parameter of the rooftop unit, and wherein the controller is configured to actuate the actuator based on the feedback.

26. The rooftop unit of claim 24, wherein the tether comprises a chain, a cable, or a wire.

27. The rooftop unit of claim 24, wherein the heating coil is rotatably coupled to the enclosure via a hinge assembly, wherein the hinge assembly comprises:

an upper guide coupled to the enclosure, a lower guide coupled to the heating coil; and a rod extending through the upper guide and the lower guide, wherein the rod is rotatably coupled to the upper guide and is fixedly coupled the lower guide.

28. The rooftop unit of claim 24, wherein the heating coil is oriented generally parallel to the evaporator in the first orientation.

29. The rooftop unit of claim 28, wherein a case of the heating coil is configured to engage with a case of the evaporator in the first orientation, wherein a gasket is coupled to the case of the heating coil, the case of the evaporator, or both, and wherein the case of the heating coil is configured to compress the gasket against the case of the evaporator in the first orientation.

30. The rooftop unit of claim 24, wherein the heating coil is disposed entirely within the enclosure in the first orientation and in the second orientation.

* * * * *